US009304470B2

(12) United States Patent
Tanaka

(10) Patent No.: US 9,304,470 B2
(45) Date of Patent: Apr. 5, 2016

(54) IMAGE FORMING APPARATUS AND IMAGE FORMING METHOD

(71) Applicant: KYOCERA Document Solutions Inc., Osaka (JP)

(72) Inventor: Kei Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/464,725

(22) Filed: Aug. 21, 2014

(65) Prior Publication Data

US 2015/0055969 A1 Feb. 26, 2015

(30) Foreign Application Priority Data

Aug. 21, 2013 (JP) ..... 2013-171556

(51) Int. Cl.
*G03G 15/20* (2006.01)
*G03G 15/00* (2006.01)

(52) U.S. Cl.
CPC ..... *G03G 15/6529* (2013.01); *G03G 15/205* (2013.01); *G03G 2215/00556* (2013.01); *G03G 2215/00603* (2013.01)

(58) Field of Classification Search
CPC ..... G03G 15/205; G03G 15/6529; G03G 2215/00556; G03G 2215/00603
USPC ..... 399/122, 320, 332, 396, 400
See application file for complete search history.

(56) References Cited

U.S. PATENT DOCUMENTS 5,289,247 A * 2/1994 Takano ..... G03G 15/2042 399/45
2002/0012543 A1* 1/2002 Nakamura ..... G03G 21/20 399/69
2012/0045241 A1* 2/2012 Takahashi ..... G03G 15/2032 399/70
2013/0195477 A1* 8/2013 Seshita et al. ..... 399/33

FOREIGN PATENT DOCUMENTS

JP H03-038681 A 7/1989
JP 2006-242982 A 9/2006
JP 2006-267872 A 10/2006
JP 2012232832 A * 11/2012

* cited by examiner

*Primary Examiner* — Francis Gray
(74) *Attorney, Agent, or Firm* — Hawaii Patent Services; Nathaniel K. Fedde; Kenton N. Fedde

(57) ABSTRACT

An image forming apparatus is provided which shortens the time for image formation, thereby improving the convenience. To achieve this, the control part of the image forming apparatus has a job data acquisition part and a conveyance speed control part. The job data acquisition part acquires job data from an operation panel part, a document reading part, an external terminal, or the like. The conveyance speed control part measures the temperature of a temperature sensor at the time of initial start-up operation of conveying a recording sheet, and at the time when the recording sheet has reached a registration roller pair, respectively. Further, the conveyance speed control part selects whether or not to wait for a prescribed waiting time and whether or not to reduce the fixing speed below a normal speed, according to a condition corresponding to the respective measured temperatures.

13 Claims, 4 Drawing Sheets

IMAGE FORMING APPARATUS AND IMAGE FORMING METHOD

INCORPORATION BY REFERENCE

This application is based on and claims the benefit of priority from Japanese Patent Application No. 2013-171556 filed on Aug. 21, 2013, the contents of which are hereby incorporated by reference.

BACKGROUND

The present disclosure relates to an image forming apparatus and an image forming method, and particularly to an image forming apparatus and an image forming method which control the speed of conveyance of a recording sheet by a fixing part.

A typical image forming apparatus, such as a Multifunctional Peripheral (MFP), which can print a document or an image, is known.

Such image forming apparatus is provided with an image forming part by using the electrophotographic technology. This image forming part includes a fixing part which uses a heated fixing roller, and the like, for fixing a toner image transferred on a recording sheet.

For example, a typical image forming apparatus includes an image forming part for forming an image on a medium, a setting part for setting operating conditions for the image forming part, and a control part for controlling the image forming part. With such an image forming apparatus, the control part controls the fixing part temperature and the image forming speed of the image forming part on the basis of the operating conditions. In other words, such an image forming apparatus switches over the fixing part temperature and the image forming speed, depending upon the number of sheets to be outputted for an image-formed matter to be output.

SUMMARY

An image forming apparatus of the present disclosure includes a conveyance part, a registration part, a fixing part, a temperature sensor, and a conveyance speed control part. The conveyance part conveys a recording sheet. The registration part once stops the recording sheet conveyed by the conveyance part. The fixing part heats the recording sheet which is conveyed from the registration part, and on which a toner image is formed on the basis of an electrostatic latent image, while conveying and passing it, thereby fixing the toner image on the recording sheet. The temperature sensor measures the temperature of the fixing part. The conveyance speed control part uses the temperature sensor for causing it to measure the temperature of the fixing part at the time when the recording sheet has reached the registration part. On the basis of this measured temperature, the conveyance speed control part selects whether or not to wait for a prescribed waiting time, and whether or not to reduce the speed of conveyance of the recording sheet by the fixing part below the normal speed (normal conveying speed).

The image forming method of the present disclosure is an image forming method which is executed by an image forming apparatus provided with a conveyance part, a registration part, and a fixing part. The conveyance part conveys the recording sheet. The registration part once stops the recording sheet which is conveyed by the conveyance part. The fixing part heats the recording sheet which is conveyed from the registration part, and on which a toner image is formed on the basis of an electrostatic latent image, while conveying and passing it, thereby fixing the toner image on the recording sheet. Further, the temperature of the fixing part at the time when the recording sheet has reached the registration part is measured. Further, on the basis of the measured temperature, it is selected whether or not to wait for a prescribed waiting time, and whether or not to reduce the speed of conveyance of the recording sheet by the fixing part below the normal speed (normal conveying speed).

DETAILED DESCRIPTION

[Configuration of Entire Image Forming Apparatus 1]

Figure 3:
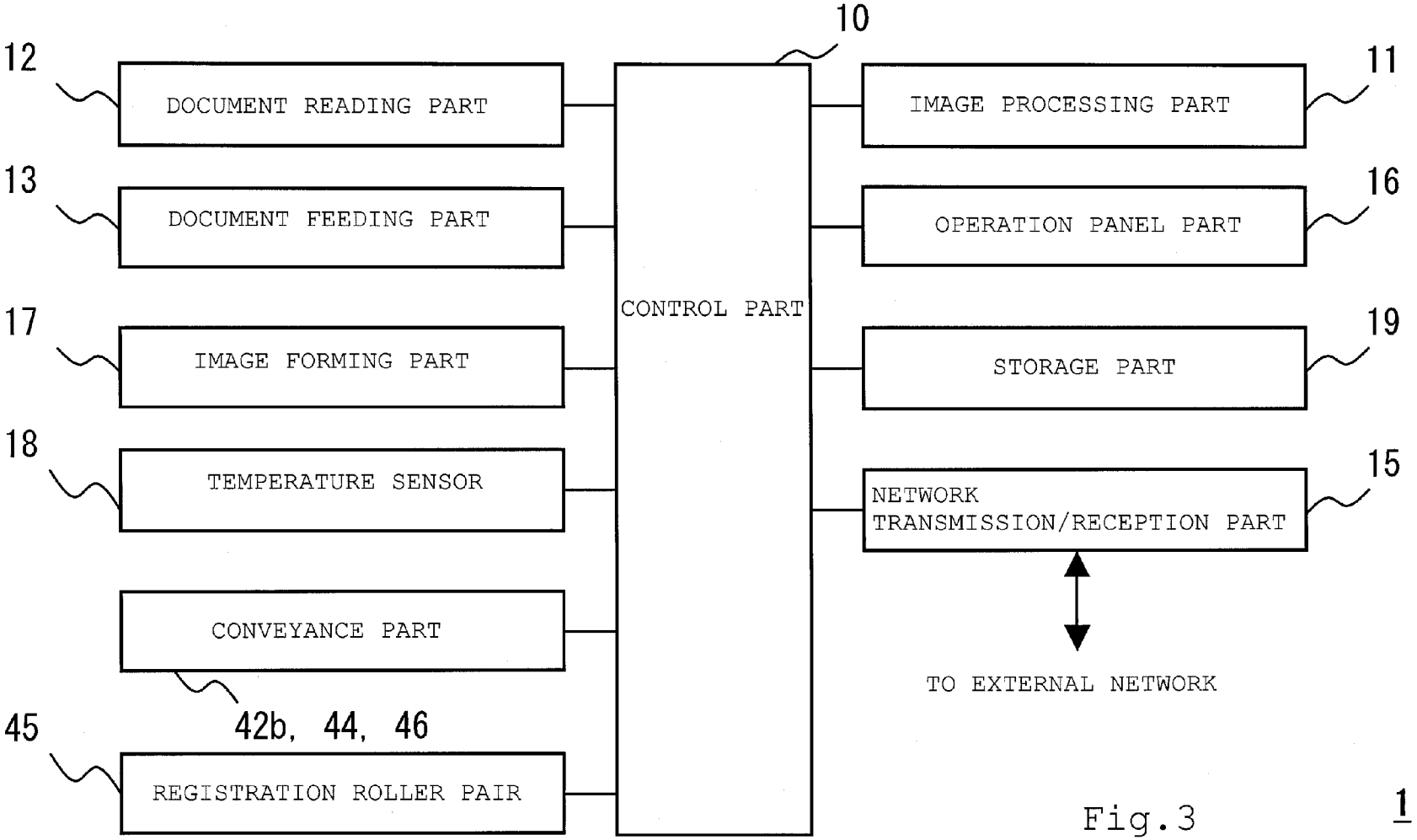
FIG. 3 is a block diagram illustrating the entire configuration according to the embodiment of the image forming apparatus of the present disclosure.

First, with reference to FIG. 3, the system configuration of the image forming apparatus 1 will be explained.

With the image forming apparatus 1, an image processing part 11, a document reading part 12, a document feeding part 13, a conveyance part (a feed roller 42*b*, a conveyance roller pair 44, and a discharge roller pair 46), a registration roller pair 45 (a registration part), a network transmission/reception part 15, an operation panel part 16, an image forming part 17, a temperature sensor 18, a storage part 19, and the like, are connected to a control part 10. Operation of each part is controlled by the control part 10.

The control part 10 is an information processing part.

The control part 10 reads out a control program stored in the storage part 19. The control part 10 expands the control program in an RAM for executing it. Thereby, the control part 10 is operated as the respective parts of a functional block as described later. In addition, the control part 10 controls the entire apparatus in response to prescribed instruction information. Such prescribed instruction information can be inputted from an external terminal (not shown) or the operation panel part 16.

The image processing part 11 is a control arithmetic unit. The image processing part 11 performs prescribed image processing on the image data. The image processing part 11 performs various types of image processing, such as enlargement/reduction, density adjustment, and gradation adjustment, and image improvement.

The image processing part 11 causes an image read out by the document reading part 12 to be stored as printing data in the storage part 19. In this case, the image processing part 11 possibly convert the printing data to another format data by a file basis.

The document reading part 12 reads (scans) the document set.

The document feeding part 13 feeds a document to be read by the document reading part 12.

The image forming part 17 forms an image on a recording sheet P on the basis of the data. As the data, for example, data stored in the storage part 19, data read by the document reading part 12, data acquired from an external terminal, or the like, may be used. Further, during the case of a standby state, the power supply for the image forming part 17 is shut off for power saving. Therefore, the temperature of the fixing part 17*e* (FIG. 4) in the image forming part 17 is lowered in accordance with the time for the standby state, and the like.

Figure 4:
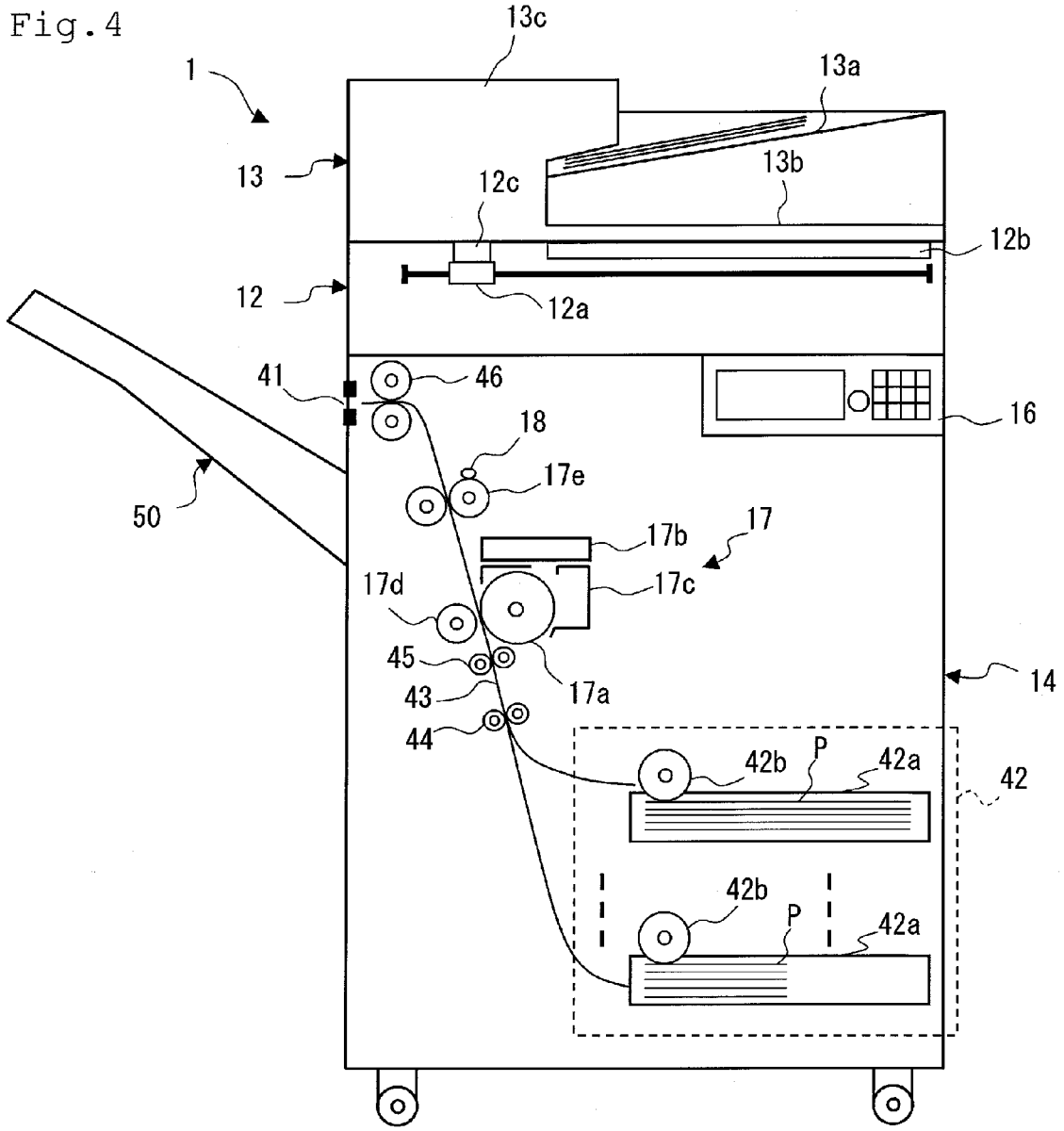
FIG. 4 is a schematic drawing of the image forming apparatus according to the embodiment of the present disclosure.

The temperature sensor 18 is a temperature detection sensor for measuring the temperature of the fixing part 17*e* (FIG. 4).

The conveyance part conveys a recording sheet P from a paper feeding cassette 42*a* to the image forming part 17. Thereby, the image forming part 17 forms an image on the recording sheet P. Further, the conveyance part conveys the recording sheet P on which an image has been formed to a stack tray 50.

The registration roller pair 45 once stops the recording sheet P, which has been conveyed by the conveyance part, before an image being formed thereon by the image forming part 17.

The operations of the document reading part 12, the document feeding part 13, the conveyance part, the registration roller pair 45, the image forming part 17, and the temperature sensor 18 will be described later.

The network transmission/reception part 15 is a network connection part for connecting to an external network.

The network transmission/reception part 15 uses a circuit for data communication to transmit/receive data, and an audio telephone circuit for transmitting/receiving an audio signal.

The operation panel part 16 includes a display part and an input part. The input part includes buttons for selecting an operation mode, buttons for giving an instruction related to execution of a job, a touch panel, and the like. The buttons for selecting an operation mode potentially include ten keys; a start key; a cancel key; and buttons for giving an instruction, such as copying, facsimile transmitting, or scanning. The buttons for giving an instruction related to execution of a job potentially include instruction buttons for jobs, such as printing, transmission, saving, and recording for the selected document.

In other words, the operation panel part 16 acquires instructions given by the user for various jobs to be made by the image forming apparatus 1. The operation panel part 16 can also receive or modify a particular user's information on the basis of an instruction given by the user to the operation panel part 16.

The storage part 19 is a storage part which uses a non-transitory recording medium.

The storage part 19 may hold the stored contents even when it is in the power saving state.

The storage part 19 stores a control program for performing operation-control of the image forming apparatus 1. In addition to this, the storage part 19 stores an account setting for a user. Further, the storage part 19 may include an area for use as a saving folder for each particular user.

In the image forming apparatus 1, the control part 10 and the image processing part 11 may be formed as an integral part.

Further, the control part 10 and the image processing part 11 may incorporate a recording medium.

In addition, the image forming apparatus 1 may include a facsimile transmission/reception part for performing facsimile transmission/reception.

[Operation of Image Forming Apparatus 1]

Then, with reference to FIG. 4, the operation of the image forming apparatus 1 according to the embodiment of the present disclosure will be explained.

The document reading part 12 is disposed above the main part 14, and the document feeding part 13 is disposed above the document reading part 12. The stack tray 50 is disposed on the side of a discharge port 41 for recording sheets that is formed in the main part 14. Further, the operation panel part 16 is disposed on the front side of the image forming apparatus 1.

The document reading part 12 includes a scanner 12*a*, a platen glass 12*b*, and a document reading slit 12*c*.

The scanner 12*a* is constituted by an exposure lamp, an imaging sensor, and the like. Further, the scanner 12*a* is movable in a direction of conveyance of a document by the document feeding unit 13.

The platen glass 12*b* is a document table formed of a transparent material. The document reading slit 12*c* has a slit which is formed in a direction orthogonal to the direction of conveyance of a document by the document feeding part 13.

In case of reading a document placed on the platen glass 12*b*, the scanner 12*a* is moved to a position opposed to the platen glass 12*b*. The scanner 12*a* reads the document placed on the platen glass 12*b* while scanning the document for acquiring image data. The scanner 12*a* outputs the acquired image data to the main part 14.

Further, when the scanner 12*a* is to read a document fed by the document feeding part 13, the scanner 12*a* is moved to a position opposed to the document reading slit 12*c*. The scanner 12*a* reads the document through the document reading slit 12*c* in synchronization with the document feeding operation of the document feeding part 13 for acquiring image data. The scanner 12*a* outputs the acquired image data to the main part 14.

The document feeding part 13 includes a document mounting part 13*a*, a document discharge part 13*b*, and a document feeding mechanism 13*c*. The documents placed in the document mounting part 13*a* are fed in turn one by one by the document feeding mechanism 13*c*. And each document is fed to a position opposed to the document reading slit 12*c*. Thereafter the document is discharged into the document discharge part 13*b*.

The document feeding part 13 may be configured to be tiltable. In this case, the top face of the platen glass 12*b* can be opened by bringing the document feeding part 13 upward.

The main part 14 includes an image forming part 17. In addition, the main part 14 includes a paper feeding part 42, a paper conveying passage 43, a conveyance roller pair 44, a registration roller pair 45, and a discharge roller pair 45.

The paper feeding part 42 includes one or a plurality of paper feeding cassettes 42*a*, and a feed roller 42*b* corresponding to the respective paper feeding cassettes 42*a*. The paper feeding cassettes 42*a* may contain recording sheets, which are different in size or orientation, respectively. The feed roller 42*b* feeds the recording sheets one by one from the paper feeding cassette 42*a* to the paper conveying passage 43. The feed roller 42*b*, the conveyance roller pair 44, and the discharge roller pair 46 function as a conveyance part.

The recording sheet is conveyed by the conveyance part, and the registration roller pair 45 controls the timing for recording. In other words, the recording sheet fed by the feed roller 42*b* into the paper conveying passage 43 is conveyed by the conveyance roller pair 44 toward the image forming part 17. The recording sheet which has been conveyed is once stopped by the registration roller pair 45 before being conveyed into the image forming part 17. The recording sheet having reached the registration roller pair 45 is detected by an optical sensor (not shown), or the like. The recording sheet which has been detected to have reached the registration roller pair 45 is conveyed into the image forming part 17 at a prescribed timing under the control of the control part 10 after having been positioned and adjusted for margin width at the paper leading end. The recording sheet which has been conveyed into the image forming part 17 and provided with a record is discharged into the stack tray 50 by the discharge roller pair 46.

The image forming part 17 includes a photosensitive drum 17*a*, an exposure part 17*b*, a developing part 17*c*, a transfer part 17*d*, and a fixing part 17*e*.

The exposure part 17*b* outputs light on the basis of the image data to expose the photosensitive drum 17*a* thereto. Thereby, the exposure part 17*b* forms an electrostatic latent image on the surface of the photosensitive drum 17*a*.

The developing part 17*c* is a developing unit which uses toner for developing the electrostatic latent image formed on the photosensitive drum 17*a*. The developing part 17*c* causes a toner image to be formed on the photosensitive drum 17*a* on the basis of the electrostatic latent image.

The transfer part 17*d* causes the toner image formed on the photosensitive drum 17*a* by the developing part 17*c* to be transferred onto the recording sheet.

The fixing part 17*e* causes the toner image to be fixed on the recording sheet by heating the recording sheet on which the toner image has been transferred by the transfer part 17*d*. The fixing part 17*e* includes, for example, a heating roller, a fusion roller, a heating belt, a pressing roller, and a heating source. The heating belt is a belt for fixing the toner on the recording sheet. The heating belt is stretched between the heating roller and the fusion roller. The pressing roller is a roller for pressing the recording paper against the heating belt. The pressing roller is disposed with its outer peripheral surface being in contact with the heating belt. The heating source is a source for heating the heating belt, such as a ceramic heater or a halogen heater. The heating source is disposed inside of the heating roller or around the heating roller.

In the case where the temperature of the heating roller is equal to or above a first prescribed temperature (FIG. 1), the fixing part 17*e* may fix the toner image on the recording sheet at a normal speed. Further, even if the temperature of the heating roller is under the first prescribed temperature, but the temperature of the heating roller is at a prescribed temperature equal to or higher than the temperature at which the toner is melted, the fixing part 17*e* can fix the toner image on the recording sheet at a reduced speed, which is lower than the normal speed. The fixing part 17*e* may be able to be heated from the room temperature to a temperature at which the fixing can be performed at a reduced speed, within, for example, a few seconds after the moment when the power switch for the heating source has been turned on. In such few seconds, the conveyance part may allow the recording sheet to reach the registration roller pair 45.

The fixing part 17*e* may be configured to be heated by electromagnetic induction heating.

The temperature sensor 18 is a temperature detection sensor for measuring the temperature of the fixing part 17*e* (FIG. 4). The temperature sensor 18 may be in contact with, for example, the fusion roller, the heating belt, or the pressing roller. The temperature sensor 18 may detect a change in electric resistance, or the like, in response to a change in temperature. The detected signal of the temperature sensor 18 may be subjected to A/D-conversion, or the like, to be outputted as a measurement value of the temperature of the fixing part 17*e*.

[System Configuration of Image Forming Apparatus 1]

Figure 1:
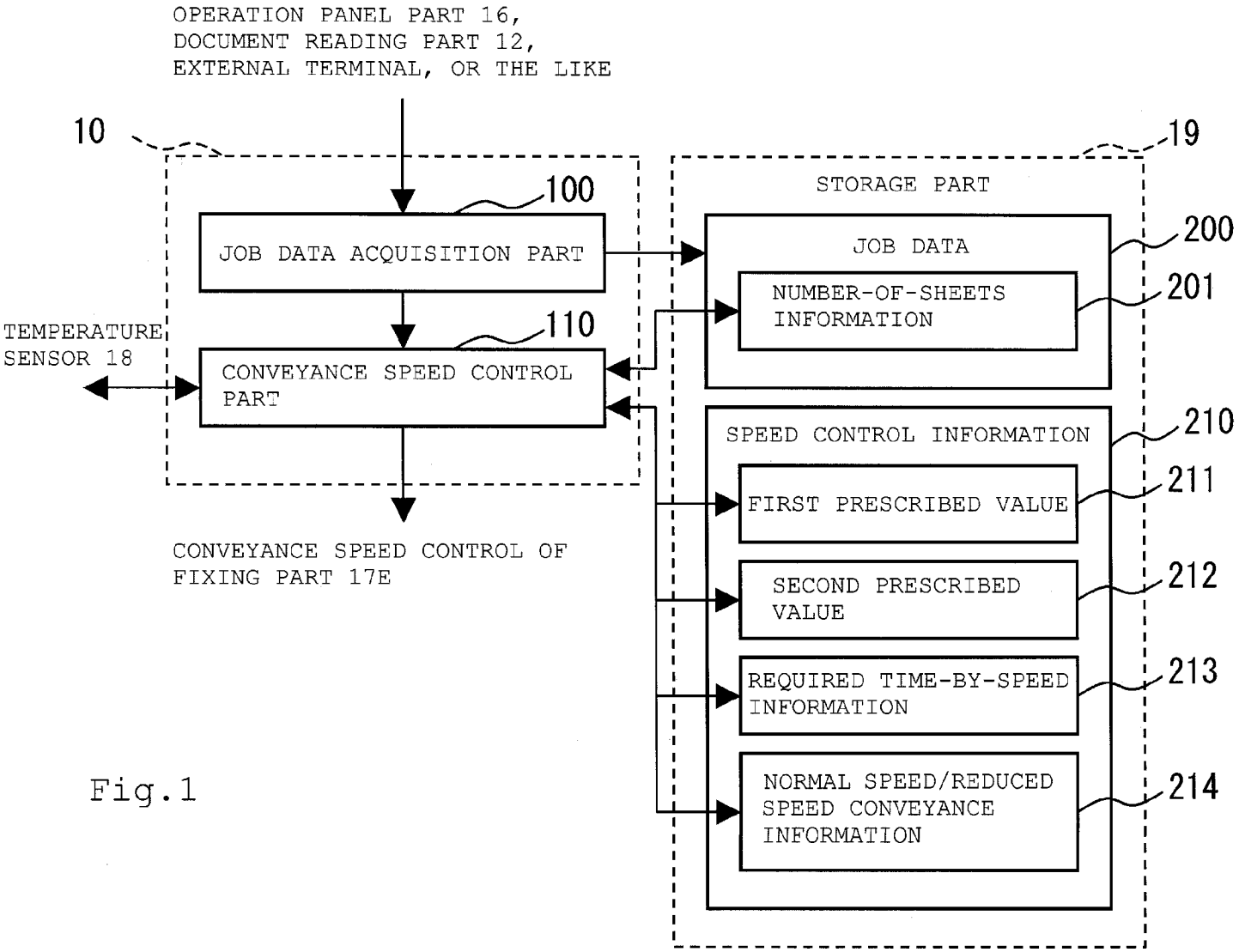
FIG. 1 is a system configuration drawing according to an embodiment of an image forming apparatus of the present disclosure.

Here, with reference to FIG. 1, the system configuration of the image forming apparatus 1 will be explained.

The control part 10 of the image forming apparatus 1 includes a job data acquisition part 100 and a conveyance speed control part 110.

The storage part 19 stores job data 200 and speed control information 210.

The job data acquisition part 100 acquires the job data 200 to store it in the storage part 19. The job data acquisition part 100 may acquire the job data 200 from the document reading part 12, the network transmission/reception part 15, the saving folder for a user in the storage part 19, an external terminal (not shown), or the like.

The conveyance speed control part 110 uses the temperature sensor 18 to measure the temperature of the fixing part 17*e*. The conveyance speed control part 110 measures the temperature of the fixing part 17*e* at the time of initial start-up operation of conveying the recording sheet, and that at the time when the recording sheet has reached the registration roller pair 45, respectively. According to a condition corresponding to the respective measured temperatures, the conveyance speed control part 110 selects the speed of conveyance of the recording sheet by the conveyance part (FIG. 4) or that by the fixing part 17*e* in the image forming part 17 (hereinafter to be referred to as the "fixing speed"). Specifically, the conveyance speed control part 110 selects, for example, whether or not to wait with the normal speed being maintained or whether or not to wait, or whether or not to reduce the fixing speed below the normal speed.

Further, as a condition for changing the conveyance speed, if the temperature of the temperature sensor 18 at the time of initial start-up operation of conveying the recording sheet is equal to or above a first prescribed value 211, the conveyance speed control part 110 sets the fixing speed at the normal speed. Further, if the temperature of the temperature sensor 18 at the time of initial start-up operation of conveying the recording sheet is under the first prescribed value 211, the conveyance speed control part 110 reduces the fixing speed below the normal speed. As such fixing speed, which is lower than the normal speed, the conveyance speed control part 110 may establish a speed as half as the normal speed, for example.

Further, if the temperature of the temperature sensor 18 at the time when the recording sheet has reached the registration roller pair 45 is equal to or above the first prescribed value 211, the conveyance speed control part 110 sets the fixing speed at the normal speed for conveying the recording sheet from the registration roller pair 45. Further, if the temperature of the temperature sensor 18 at the time when the recording sheet has reached the registration roller pair 45 is under the first prescribed value 211 and equal to or above a second prescribed value 212, the conveyance speed control part 110 waits until the temperature of the fixing part 17*e* is raised to a temperature equal to or above the first prescribed value 211, and then sets the fixing speed at the normal speed, causing the recording paper to be conveyed from the registration roller pair 45. Further, if the temperature of the temperature sensor 18 at the time when the recording sheet has reached the registration roller pair 45 is under the second prescribed value 212, the conveyance speed control part 110 reduces the fixing speed below the normal speed for conveying the recording sheet from the registration roller pair 45.

Further, in the case where an image is to be continuously formed on the recording sheet, the conveyance speed control part 110 may calculate the time Ta required for waiting until the temperature of the fixing part 17*e* is raised, and then forming an image at the normal speed, and the time Tb required for forming an image at a fixing speed below the normal speed for comparison between these. The conveyance speed control part 110 may control the fixing speed by selecting the required time Ta or Tb, whichever is the shorter.

The job data 200 is data for a document, or the like, that has been acquired by the job data acquisition part 100. The job data 200 may include, for example, character data, image data, and other types of data.

Further, the job data 200 may be, for example, image data which has been read in the document reading part 12, and subjected to image processing in the image processing part 11. In this case, the job data 200 may be a bitmap image file, a lightly compressed file, or the like. In addition, the job data 200 may be data which has been converted in the image processing part 11 or the control part 10. Further, document data, image data, or the like, which is brought in by the user, being stored in an external recording medium, may be acquired by the job data acquisition part 100 as the job data 200.

Further, the job data 200 includes number-of-sheets information 201.

The number-of-sheets information 201 is information including the number of recording sheets on which an image is to be formed. The number-of-sheets information 201 may include information about the size of the recording sheet, the number of sheets, whether the printing is to be performed by color or black and white, and the like. The number-of-sheets information 201 is used when the conveyance speed control part 110 calculates the time to the completion of image formation for the job data 200.

The speed control information 210 is information which is to be referenced when the conveyance speed control part 110 controls the fixing speed.

The speed control information 210 includes the first prescribed value 211 (a first prescribed value), the second prescribed value 212 (a second prescribed value), required time-by-speed information 213, and normal speed/reduced speed conveyance information 214.

The first prescribed value 211 is a value corresponding to the normal fixing temperature at which a toner image can be fixed on the recording sheet by the fixing part 17*e*.

The second prescribed value 212 is a value corresponding to a prescribed temperature lower than the temperature which corresponds to the first prescribed value 211. As the second prescribed value 212, a value corresponding to a temperature as low as that which allows the fixing temperature to be raised to the first prescribed value 211 within a prescribed time may be set. As such prescribed time, a value of which the user is not conscious as a waiting time, for example, a time as short as a few seconds may be used.

The required time-by-speed information 213 includes constant values, and the like, for calculating the time required for waiting until the temperature of the fixing part 17*e* is raised, and then forming an image at the normal speed, and the time required for forming an image at a fixing speed below the normal speed. The normal speed of the conveyance speed is a standard speed of conveyance of the recording sheet by the fixing part 17*e* of the image forming apparatus 1. Such normal speed may be set on the basis of an inherent speed for the image forming apparatus 1, the paper quality of the recording sheet, a setting stored in the storage part 19, and the like. Further, the reduced speed may be a speed, for example, as low as half the normal speed. The reduced speed may be a speed which, while the recording sheet reaches the registration roller pair 45 after the initial operation, allows the temperature of the fixing part 17*e* to be raised from a prescribed room temperature to a temperature at which the fixing on the recording sheet can be performed.

The normal speed/reduced speed conveyance information 214 includes values corresponding to the normal speed of conveying the recording sheet in the fixing part 17*e*, and a reduced speed, which is lower than such normal speed. The normal speed/reduced speed conveyance information 214 is referenced when the conveyance speed control part 110 changes the fixing speed.

By executing a control program stored in the storage part 19, the control part 10 of the image forming apparatus 1 functions as the job data acquisition part 100 and the conveyance speed control part 110.

In addition, the above-described respective parts of the image forming apparatus 1 provide hardware resources for executing an image forming method according to the embodiment of the present disclosure.

[Conveyance Speed Control Processing by Image Forming Apparatus 1]

Figure 2:
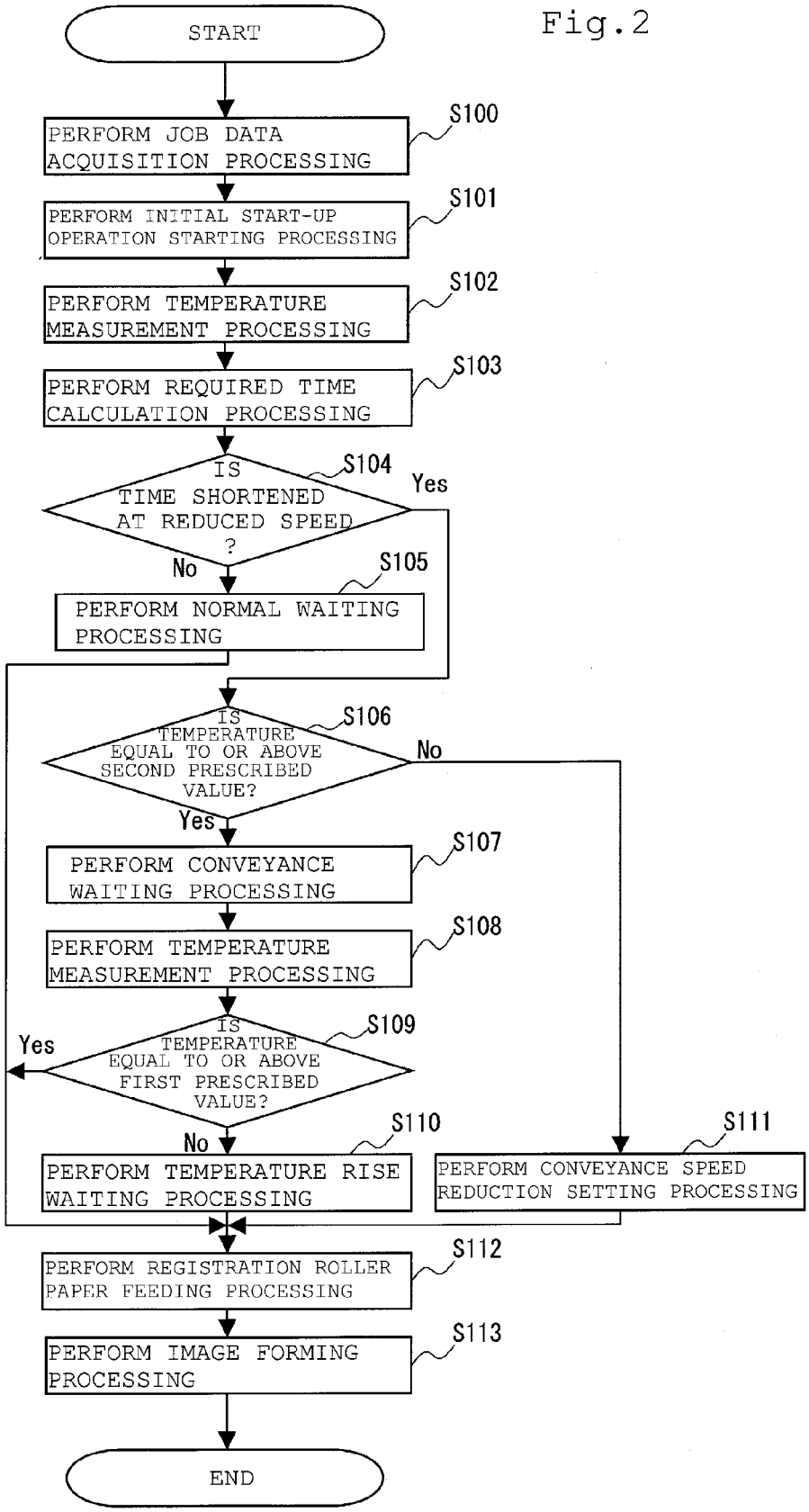
FIG. 2 is a flowchart for conveyance speed control processing according to the embodiment of the present disclosure.

Next, with reference to FIG. 2, the conveyance speed control processing by the image forming apparatus 1 according to the embodiment of the present disclosure will be explained.

The conveyance speed control processing of the present embodiment controls the fixing speed in order to shorten the time to the completion of image formation. At this time, how to perform the control is determined by measuring the temperature of the fixing part 17*e* at the time of initial start-up operation of conveying the recording sheet, and at that when the recording sheet has reached the registration roller pair 45, respectively.

The conveyance speed control processing in the present embodiment is executed mainly by the control part 10 executing the programs which are stored in the storage part 19, using the hardware resources in cooperation with the respective parts.

Hereinbelow, with reference to the flowchart in FIG. 2, the details of the conveyance speed control processing will be explained for each step.

(Step S100)

First, the control part 10 uses the job data acquisition part 100 for performing job data acquisition processing.

When the control part 10 acquires a user instruction from the operation panel part 16, the control part 10 causes the document placed on the document reading part 12 to be read, and the storage part 19 to store it as the job data 200.

Further, the control part 10 may cause the job data 200 transmitted from another terminal or a server (not shown) to be acquired from the network transmission/reception part 15 and to be stored in the storage part 19.

Further, the control part 10 may cause a file to be acquired from a user saving folder, and to be stored in the storage part 19.

Further, the control part 10 may cause the job data 200 to be acquired from a recording medium (not shown) which is connected to the outside, and to be stored in the storage part 19.

(Step S101)

Next, the control part 10 uses the conveyance speed control part 110 for performing initial start-up operation starting processing.

The control part 10 performs initialization of the respective parts, and supplies power to the image forming part 17. Thereby, heating of the heating source of the fixing part 17*e* is initiated.

Further, the control part 10 causes the conveyance part to start conveying a paper from the paper feeding cassette 42*a* which has been specified by the job data 200.

Further, the control part 10 references the normal speed/reduced speed conveyance information 214 in the storage part 19 for controlling the conveyance speed of the fixing part 17*e* so as to be the normal speed. For example, the control part 10 adjusts the turning speed of the heating roller and the fusion roller in the fixing part 17*e* for controlling the speed of the heating belt so as to be the normal speed. In other words, the control part 10 may first control the fixing speed so as to be the normal speed as a prescribed operation. And, in the case where a particular condition is applied in the subsequent process, the control part 10 may control the fixing speed so as to be a reduced speed.

After completion of the image formation for the previous job data 200, the power supply to the image forming part 17 has been shut off, the image forming part 17 being in a standby state. In other words, the temperature of the fixing part 17*e* has been lowered. This temperature varies depending upon the time for which the image forming part 17 has been in the standby state.

Therefore, even if the same electric power is applied at the time when this process turns on the power, by what degrees the temperature of the fixing part 17*e* must be raised varies depending upon the state of the fixing part 17*e*.

(Step S102)

Next, the control part 10 uses the conveyance speed control part 110 for performing temperature measurement processing.

The control part 10 acquires the temperature of the fixing part 17*e* that has been measured by the temperature sensor 18. In addition to the measured temperature of the fixing part 17*e*, the control part 10 may calculate an acceleration of temperature rise, or the like.

(Step S103)

Next, the control part 10 uses the conveyance speed control part 110 for performing required time calculation processing.

The control part 10 references the required time-by-speed information 213 in the storage part 19 to calculate the value of Ta. The symbol Ta denotes the time required for waiting until the temperature of the fixing part 17*e* is raised to a temperature equal to or above the first prescribed value 211, and then forming an image at the normal speed. The control part 10 may calculate this time, Ta, by using, for example, the following Eq. (1):

$$Ta=A\times N+C \quad \text{Eq. (1)}$$

As described above, in Eq. (1), the symbol Ta denotes the time required for forming an image at the normal speed. The symbol A denotes the time per recording sheet when the image formation is carried out at the normal speed. The symbol N denotes a value of the number of sheets for the job data 200, or the like, on the number-of-sheets information 201. The symbol C denotes the waiting time for which the recording sheet P is to be waited at the registration roller pair 45 until the temperature of the fixing part 17*e* is raised to a temperature equal to or above the first prescribed value 211.

The control part 10 may use the number-of-sheets information 201 to calculate the necessary value of N, which denotes the number of sheets for the job data 200, or the like. At this time, the control part 10 may use the information about whether the printing is by color or black and white, the size of the recording sheet, and the like, among the number-of-sheets information 201. This description is also true for the following Eq. (2).

Further, the control part 10 also calculates the time Tb. The symbol Tb denotes the time required for forming an image at a fixing speed below the normal speed. The control part 10 may calculate the value of Tb by using, for example, the following Eq. (2):

$$Tb=B\times N \quad \text{Eq. (2)}$$

As described above, in Eq. (2), the symbol Tb denotes the time required for forming an image at a reduced speed, which is lower than the normal speed. The symbol B denotes the time per recording sheet for which image formation is performed at the reduced speed. The symbol N denotes a value of the number of sheets for the job data 200, or the like, on the number-of-sheets information 201.

(Step S104)

Next, the control part 10 uses the conveyance speed control part 110 for determining whether the time is shortened or not at the reduced speed. The control part 10 compares Ta with Tb. As described above, the symbol Ta denotes the time required for forming an image at the normal speed (including the waiting time until the temperature is raised) which has been calculated by the required time calculation processing. Further, the symbol Tb denotes the time required for forming an image at the reduced speed. In the case where Tb is under Ta, the control part 10 determines YES because forming an image at the reduced speed will shorten the necessary time. In any other case, the control part 10 determines NO because forming an image at the normal speed will shorten the time required for image formation or make no change therein.

In the case of YES, the control part 10 advances the program to Step S106.

In the case of NO, the control part 10 advances the program to Step S105.

(Step S105)

In the case where forming an image at the normal speed will shorten the necessary time, the control part 10 uses the conveyance speed control part 110 for performing normal waiting processing.

The control part 10 stops the recording sheet which has been conveyed to the registration roller pair 45, while waiting until a prescribed waiting time elapses from the initial start-up operation starting. The control part 10 may set the value of C in the above-mentioned Eq. (1) as this prescribed waiting time. Further, in the case where the control part 10 calculates an acceleration of temperature rise of the temperature sensor 18 in the above-mentioned Step S102, the control part 10 may use this acceleration to estimate the time until the above-mentioned first prescribed temperature is reached, thereby setting a prescribed waiting time.

In addition, the control part 10 may cause the temperature of the temperature sensor 18 to be measured in real time while waiting until the above-mentioned first prescribed temperature is reached.

Thereafter, the control part 10 advances the program to Step S112.

(Step S106)

In the case where forming an image at the reduced speed will shorten the necessary time, the control part 10 uses the conveyance speed control part 110 for determining whether or not the temperature is equal to or above the second prescribed value 212. In the case where the measured temperature of the fixing part 17*e* is equal to or above the second prescribed value 212 in the speed control information 210, the control part 10 determines YES. In any other case, in other words, in the case where the measured temperature is under the second prescribed value 212, the control part 10 determines NO.

In the case of YES, the control part 10 advances the program to Step S107.

In the case of NO, the control part 10 advances the program to Step S111.

(Step S107)

In the case where the measured temperature of the fixing part 17*e* is equal to or above the second prescribed value 212, the control part 10 uses the conveyance speed control part 110 for performing conveyance waiting processing.

The control part 10 waits until the recording sheet is conveyed to the registration roller pair 45 from the paper feeding cassette 42*a* by the conveyance part.

(Step S108)

Next, the control part 10 uses the conveyance speed control part 110 for performing temperature measurement processing.

The control part 10 again measures the temperature of the fixing part 17*e*. This process is performed in the same manner as in the above-mentioned Step S102.

(Step S109)

Next, the control part 10 uses the conveyance speed control part 110 for again determining whether the measured temperature is equal to or above the first prescribed value 211.

In the case of YES, in other words, where the measured temperature is equal to or above the first prescribed value 211, the control part 10 advances the program to Step S112.

In the case of NO, in other words, where the measured temperature is under the first prescribed value 211, the control part 10 advances the program to Step S110.

(Step S110)

In the case where the measured temperature of the fixing part 17*e* is under the first prescribed value 211, the control part 10 again uses the conveyance speed control part 110 for performing temperature rise waiting processing.

Here, although the temperature of the fixing part 17*e* is already equal to or above the second prescribed value 212, it has not yet reached the first prescribed value 211. Therefore, the control part 10 waits for a prescribed waiting time until the fixing part 17*e* has a temperature equal to or above the first prescribed value 211. As such prescribed waiting time, a fixed time of, for example, a few seconds or so may be set. Further, in the case where, in the above-mentioned Step S102, an acceleration of temperature rise of the temperature sensor 18 has been calculated, the control part 10 may use this acceleration to estimate the time until the first prescribed temperature is reached, and set a prescribed waiting time. Further, the control part 10 may measure the temperature of the temperature sensor 18 in real time, while waiting until the above-mentioned first prescribed temperature is reached.

Thereafter, the control part 10 advances the program to Step S112.

(Step S111)

Here, in the case where the second prescribed value 212 has not yet been reached, the control part 10 uses the conveyance speed control part 110 for performing conveyance speed reduction setting processing.

The control part 10 references the normal speed/reduced speed conveyance information 214 in the storage part 19, and controls the speed of conveying the recording sheet in the fixing part 17*e* so as to be the reduced speed. For example, the control part 10 adjusts the turning speed of the heating roller and the fusion roller in the fixing part 17*e* for controlling the speed of the heating belt so as to be the reduced speed, which is lower than the normal speed.

(Step S112)

Here, the control part 10 uses the conveyance speed control part 110 for performing registration roller paper feeding processing.

The control part 10 causes the recording sheet which has been stopped by the registration roller pair 45 to be conveyed into the inside of the image forming part 17 in accordance with a prescribed timing.

(Step S113)

Next, the control part 10 performs image forming processing.

The control part 10 transmits the job data 200 to the image forming part 17 for causing it to perform image formation.

Here, the recording sheet on which a toner image is formed on the basis of an electrostatic latent image is subjected to fixing by the fixing part 17*e* at the normal speed or the reduced speed.

By the above way, the conveyance speed control processing according to the embodiment of the present disclosure is terminated.

By providing the above-described configuration, the following advantages will be obtained.

For example, with the conventional image forming apparatus, in the case where the number of sheets to be outputted is smaller than a threshold value, the temperature of the fixing part and the speed of image formation are simply lowered, which has increased the time required for image formation. In other words, conventionally, control of the fixing part has been performed by simply determining whether or not the number of sheets is larger than a threshold value, and thus the time required for image formation has been long. Therefore, there has been a problem of the convenience for users being lowered.

Contrarily to this, an image forming apparatus 1 according to the embodiment of the present disclosure has a conveyance part for conveying a recording sheet; a registration roller pair 45 for once stopping the recording sheet conveyed by the conveyance part; a fixing part 17*e* for heating the recording sheet conveyed from the registration roller pair 45 and having a toner image formed thereon on the basis of an electrostatic latent image by an exposure part 17*b*, a developing part 17*c*, and a transfer part 17*d*, while conveying and passing it, thereby fixing the toner image on the recording sheet; a temperature sensor 18 for measuring a temperature of the fixing part 17*e*; and a conveyance speed control part 110 for using the temperature sensor 18 to measure the temperature of the fixing part 17*e* upon the recording sheet having reached the registration roller pair 45, and on the measured temperature, selecting whether or not to wait for a prescribed waiting time, and whether or not to reduce the speed of conveying the recording sheet in the fixing part 17*e* below the normal speed.

With such a configuration, the user's waiting time until the completion of image formation for the job data 200 can be reliably shortened, thereby the convenience for users being enhanced. In other words, the time taken from the moment when the user has given an instruction for a job to that when a first one of the recording sheets on which an image has been formed is delivered to the stack tray can be shortened.

In other words, according to the present disclosure, the temperature of the fixing part upon the recording paper having reached the registration part is measured, and on the measured temperature, selects whether or not to wait, and whether or not to reduce the speed of conveyance of the recording sheet by the fixing part below the normal speed, whereby an image can be formed on the recording sheet in a time shorter than is possible with the prior art, and thus an image forming apparatus which is capable of improving the convenience for users can be provided.

In addition, there is no need for the user particularly making a setting, whereby the speed for image formation can be increased.

Further, with the image forming apparatus 1 according to the embodiment of the present disclosure, the conveyance speed control part 110, upon the temperature of the temperature sensor 18 at the time of the recording sheet having reached the registration roller pair 45 being equal to or above a first prescribed value 211, sets the fixing speed at a normal speed for causing the recording sheet to be conveyed from the registration roller pair 45; upon the temperature of the temperature sensor 18 at the time of the recording sheet having reached the registration roller pair 45 being under the first prescribed value 211 and equal to or above a second prescribed value 212, waits until the fixing part 17*e* has a temperature equal to or above the first prescribed value 211, and then sets the fixing speed at the normal speed for causing the recording sheet to be conveyed from the registration roller pair 45; and upon the temperature of the temperature sensor 18 at the time of the recording sheet having reached the registration roller pair 45 being under the second prescribed value 212, reduces the fixing speed below the normal speed for causing the recording sheet to be conveyed from the registration roller pair 45.

With such a configuration, even if the temperature of the fixing part 17*e* is under the first prescribed value 211, the need for reducing the fixing speed will be eliminated. Accordingly, image formation can be performed with no need for reducing the speed.

Further, with the image forming apparatus 1 according of the embodiment of the present disclosure, the conveyance speed control part 110, upon an image being to be continuously formed on the recording sheets, calculates the time required for waiting the temperature rise of the fixing part 17*e* and then forming the image at the normal speed, and the time required for forming an image at a fixing speed below the normal speed for comparison between these, and controls the fixing speed so as to shorten the required time.

With such a configuration, the time required for image formation can be reliably shortened. Accordingly, the convenience for users can be improved.

Further, with the image forming apparatus 1 according to the embodiment of the present disclosure, the conveyance speed control part 110 uses the temperature sensor 18 to measure the temperature of the fixing part 17*e* also at the time of initial start-up operation of conveying the recording sheet, and, as a condition for changing the conveyance speed, upon the temperature of the temperature sensor 18 at the time of initial start-up operation of conveying the recording sheet being equal to or above the first prescribed value 211, sets the fixing speed at the normal speed, and upon the temperature of the temperature sensor 18 at the time of initial start-up operation of conveying the recording sheet being under the second prescribed value 212, reduces the fixing speed below the normal speed.

By providing such a configuration to confirm the temperature at two stages, i.e., at the time of initial start-up operation, and at the time when the recording sheet has reached the registration roller pair 45, the accuracy of control by temperature will be improved. Accordingly, the fixing speed can be reliably controlled to form an image without unsatisfactory fixing, or the like, being caused.

Other Embodiments

In the embodiment of the present disclosure, it has been described that, according to conditions, the times required for image formation are calculated for comparison. However, a prescribed table may be stored in the storage part 19, and the conveyance speed control part 110 uses this table for controlling the fixing speed. In other words, in the case where the number of sheets on which an image is to be continuously formed is equal to or above a prescribed number of sheets given in the table, the conveyance speed control part 110 may not perform a control for reducing the fixing speed, thereby not varying it from the normal speed.

With such a configuration, the need for calculating the time required for image formation will be eliminated. Accordingly, the process to be performed by the control part 10 can be alleviated.

Further, in the embodiment of the present disclosure, it has been described that the speed of the fixing part 17*e* is controlled so as to be either the normal speed or the reduced speed, however, the type of speed is not limited to these. For example, the control part 10 may control "system speeds" which also include a speed other than those for the fixing part 17*e* that is to be given when the recording sheet is conveyed in the image forming part 17 after having been supplied from the registration roller pair 45. Further, the control part 10 may control the speed for the conveyance part such that it corresponds to the speed for the fixing part 17*e*. Further, the control part 10 may set a speed other than the normal speed and the reduced speed, and provide a control by switching over those, depending upon the temperature of the temperature sensor 18.

In the embodiment of the present disclosure, it has been described that the temperature is measured by the temperature sensor 18 at the time of initial start-up operation and at the time when the recording sheet has reached the registration roller pair 45, respectively. However, there may be provided a configuration in which the temperature is measured by the temperature sensor 18 only at the time when the recording sheet has reached the registration roller pair 45. In this case, if the temperature measured at the time when the recording sheet has reached the registration roller pair 45 is under the second prescribed value 212, the fixing speed may be set at a reduced speed, and at that speed, the recording sheet may be conveyed from the registration roller pair 45.

Further, the present disclosure is also applicable to information processing apparatuses excluding the image forming apparatus other than the MFP. In other words, the configuration provided may be such that it uses such a tool as a network scanner, a server to which a scanner is separately connected with a USB, or the like, or a single-function printer.

The configuration and operation of the above embodiments are examples, and of course it is possible to alter them as appropriate for implementation within the scope of the gist of the present disclosure for execution.

What is claimed is:

1. An image forming apparatus having a conveyance part for conveying a recording sheet, a registration part for once stopping the recording sheet conveyed by the conveyance part, and a fixing part for fixing a toner image, formed based on an electrostatic latent image, on the recording sheet by heating the recording sheet conveyed from the registration part and passing thereon, comprising:

a temperature sensor for measuring a temperature of the fixing part, and a conveyance speed control part for selecting whether to wait for a prescribed waiting time or not, and for reducing the conveying speed of the recording sheet to a speed less than a normal speed and by measuring temperature of the fixing part using the temperature sensor at a time when the recording sheet is reached at the registration part, on the basis of measured temperature.

2. The image forming apparatus according to claim 1, wherein the conveyance speed control part, in case of using the temperature of the fixing part measured at the time of the recording sheet having reached the registration part: the temperature is equal to or above a first prescribed value, sets the conveyance speed at a normal speed for causing the recording sheet to be conveyed from the registration part; the temperature is under the first prescribed value and equal to or above a second prescribed value, waits until the fixing part has a temperature equal to or above the first prescribed value, and sets the conveyance speed at the normal speed for causing the recording sheet to be conveyed from the registration part; and the temperature is under the second prescribed value, reduces the conveyance speed below the normal speed for causing the recording sheet to be conveyed from the registration part.

3. The image forming apparatus according to claim 1, wherein the conveyance speed control part, upon an image being to be continuously formed on the recording sheets, calculates the time required for waiting the temperature rise of the fixing part and then forming the image at the normal speed, and the time required for forming an image at a conveyance speed below the normal speed for comparison between these, and controls the conveyance speed so as to shorten the required time.

4. The image forming apparatus according to claim 1, wherein the conveyance speed control part, upon the number of sheets by which an image is to be continuously formed on the recording sheets being equal to or above a prescribed number of sheets, will not perform a control for reducing the conveyance speed, thereby not varying it from the normal speed.

5. The image forming apparatus according to claim 4, wherein the image forming apparatus comprises a storage part, having stored therein, a table that provides the prescribed number of recording sheets, and the conveyance speed control part uses the table for the determining step.

6. The image forming apparatus according to claim 1, wherein the conveyance speed control part, uses the temperature sensor to measure the temperature of the fixing part also at the time of initial start-up operation of conveying the recording sheet, and upon the temperature of the fixing part measured at the time of initial start-up operation of conveying the recording sheet being equal to or above a second prescribed value, sets the conveyance speed at the normal speed, and upon the temperature of the fixing part measured at the time of initial start-up operation of conveying the recording sheet being under the second prescribed value, reduces the conveyance speed below the normal speed.

7. The image forming apparatus according to claim 1, wherein the temperature of the fixing part is measured upon the recording sheet reaching the registration roller.

8. The image forming apparatus according to claim 1, wherein the time when the recording sheet is reached at the registration part and when the temperature is measured is prior to the recoding sheet reaching the fixing part.

9. An image forming method using an image forming apparatus having:

a conveyance part for conveying a recording sheet, a registration part for once stopping the recording sheet conveyed by the conveyance part, and a fixing part for fixing the toner image, formed based on an electrostatic latent image, on the recording sheet by heating the recording sheet conveyed from the registration part and passing thereon, comprising steps of:

measuring a temperature of the fixing part upon the recording sheet having reached the registration part, and based on the measured temperature, selecting whether or not to wait for a prescribed waiting time and whether to reduce the speed of conveying the recording sheet in the fixing part below a normal speed.

10. The method of claim 9, further comprising steps of using a control part to:

determine whether a number of recording sheets by which an image is to be continuously formed is equal to or above a prescribed number of recording sheets, and not reducing the speed conveying, thereby not varying it from the normal speed, if it is determined that the number recording sheets by which an image is to be continuously formed is equal to or above the prescribed number of recording sheets.

11. The method of claim 10, wherein:

the image forming apparatus comprises a storage part, having stored therein, a table that provides the prescribed number of recording sheets, and the conveyance speed control part uses the table for the determining step.

12. The method of claim 9, wherein the step of measuring the temperature of the fixing part is performed at the time the recording sheet reaches the registration part.

13. The method of claim 12, wherein the time the recording sheet reaches the registration part is prior to the time the recording sheet reaches the fixing part.

* * * * *